US005565827A

United States Patent [19]

Gula et al.

[11] Patent Number: 5,565,827

[45] Date of Patent: Oct. 15, 1996

[54] CIRCUIT BREAKER WITH CURRENT CONDUCTING BLOW OPEN LATCH

[75] Inventors: Lance Gula, Independence Township; Joseph F. Changle, Scott Township; Jere L. McKee, New Swickley, all of Pa.

[73] Assignee: Eaton Corporation, Cleveland, Ohio

[21] Appl. No.: 566,561

[22] Filed: Dec. 4, 1995

[51] Int. Cl.[6] ..... H01H 75/00

[52] U.S. Cl. ..... 335/16; 335/147; 218/22

[58] Field of Search ..... 335/16, 147, 193; 218/22, 27

[56] References Cited

U.S. PATENT DOCUMENTS 4,503,408 3/1985 Mrenna et al. .

4,620,076 10/1986 Mrenna et al. .

4,636,760 1/1987 Lee ..... 335/16

5,469,121 11/1995 Payet-Burin ..... 335/16

5,515,018 5/1996 DiMarco et al. ..... 335/147

*Primary Examiner*—Lincoln Donovan

*Attorney, Agent, or Firm*—Martin J. Moran

[57] ABSTRACT

A circuit breaker has an electrically conductive blow open latch which forms part of the power circuit so that only short flexible shunts are needed between the latch and trip mechanism. Load current can be conducted from the contact arm to the electrically conductive latch solely through the interface between the latch and the blow open camming surface on the contact arm, and/or through additional short flexible shunts between the latch and the contact arm, preferably adjacent the pivot of the contact arm.

16 Claims, 4 Drawing Sheets

CIRCUIT BREAKER WITH CURRENT CONDUCTING BLOW OPEN LATCH

BACKGROUND OF THE INVENTION

1. Field of the Invention

This invention relates to circuit breakers which blow open under short-circuit conditions. More particularly, the invention is directed to such a circuit breaker in which the blow open latch forms part of the power circuit between the pivoted contact arm and the trip mechanism.

2. Background Information

A common type of molded case circuit breaker has for each pole a fixed contact attached to a fixed conductor within the circuit breaker, and a moveable contact carried by a pivotally mounted contact arm. The contact arm is rotated by an operating mechanism between a closed position in which the moveable contact engages the fixed contact and an open position in which the contacts are separated. The operating mechanism can be actuated manually through a handle or automatically through a trip mechanism. Typically, the trip mechanism incorporates a thermal or delayed trip function which opens the contacts in response to a persistent overcurrent condition, and a magnetic or instantaneous trip function which opens the contacts in response to a high instantaneous current. In some trip mechanisms the thermal trip function is performed by a bimetal and the magnetic trip function is performed by an armature which is attracted by the magnetic field generated by the high current. In other types of trip mechanisms, the delayed and instantaneous trip functions are performed electronically, typically by a microprocessor.

Some of these molded case circuit breakers incorporate a blow open feature which allows the contact arm to open rapidly in response to very high currents, such as short circuit currents, without waiting for the trip mechanism to respond. Typically, this is accomplished by aligning a portion of the fixed conductor parallel to the contact arm, with the contacts closed, so that the current flows in oppositely directed adjacent paths in the fixed conductor and the contact arm. The resultant magnetic fields generate repulsion forces which, for the high currents produced by a bolted fault, are sufficient to rapidly rotate the contact arm open.

The contact arm is mounted in a support frame for rotation by the operating mechanism. The contact is pivotally connected to the support frame so that in response to very high short circuit currents, the contact arm is blown open or is rotated relative to the support frame by the above-mentioned repulsion forces. The magnitude of the current at which the contact arm is blown open is set by a blow open latch in the form of an electrically non-conductive latch member spring biased against a blow open camming surface on the pivoted end of the contact arm. This spring also permits overtravel of the operating mechanism to provide contact pressure for the contacts and to accommodate for contact wear.

The current in the protected circuit flows in the circuit breaker from a line terminal through the fixed conductor, the fixed contact, the moveable contact and the contact arm from which it passes to the trip mechanism and then to a load terminal. Typically, the circuit between the pivoted contact arm and the trip mechanism is completed by a flexible shunt which is usually a braided copper conductor. Often, this flexible shunt is connected to the contact arm between the moveable contact and the pivot, passes around the support frame and is then connected to the free end of the bimetal in the trip mechanism. This flexible shunt takes up room within the circuit breaker molded casing, and having a relatively high resistance, produces heat within the circuit breaker.

There is a need therefore, for a circuit breaker with an improved blow open capability.

There is a related need for such an improved circuit breaker having a connection between the pivoted contact arm and trip mechanism which does not produce as much heat as current circuit breakers of this type.

There is another need for such an improved circuit breaker which does not require as much space within the circuit breaker housing so that the circuit breaker may be made smaller for the same current rating or accommodate a higher current rating in the same space.

SUMMARY OF THE INVENTION

These needs and other are satisfied by the invention which is directed to a circuit breaker in which the blow open latch includes an electrically conductive latch member which bears against the blow open camming surface on the contact arm and is also connected at one end by a first short shunt to the contact arm and at the other end by a second short shunt to the trip mechanism, and typically to the free end of the bimetal. Each of these shunts can comprise a pair of conductors to further reduce heating within the circuit breaker. An extension on the electrically conductive latch member at the end connected to the trip mechanism can further shorten the second flexible shunt. The first flexible shunt can be shortened by connecting to the contact arm adjacent the pivot of the contact arm.

In a first modification of the invention, the first shunt between the contact arm and the electrically conductive latch member can be eliminated and the current can all be passed through the interface between the camming surface on the contact arm and the electrically conductive latch member. Alternatively, all of the current can be passed between the contact arm and an electrically conductive latch member through the first flexible shunt by providing electrical insulation either on the electrically conductive latch member or the blow-open camming surface on the contact arm, or both.

BRIEF DESCRIPTION OF THE DRAWINGS

A fill understanding of the invention can be gained from the following description of the preferred embodiments when read in conjunction with the accompanying drawings in which.

DESCRIPTION OF THE PREFERRED EMBODIMENT

Figure 1:
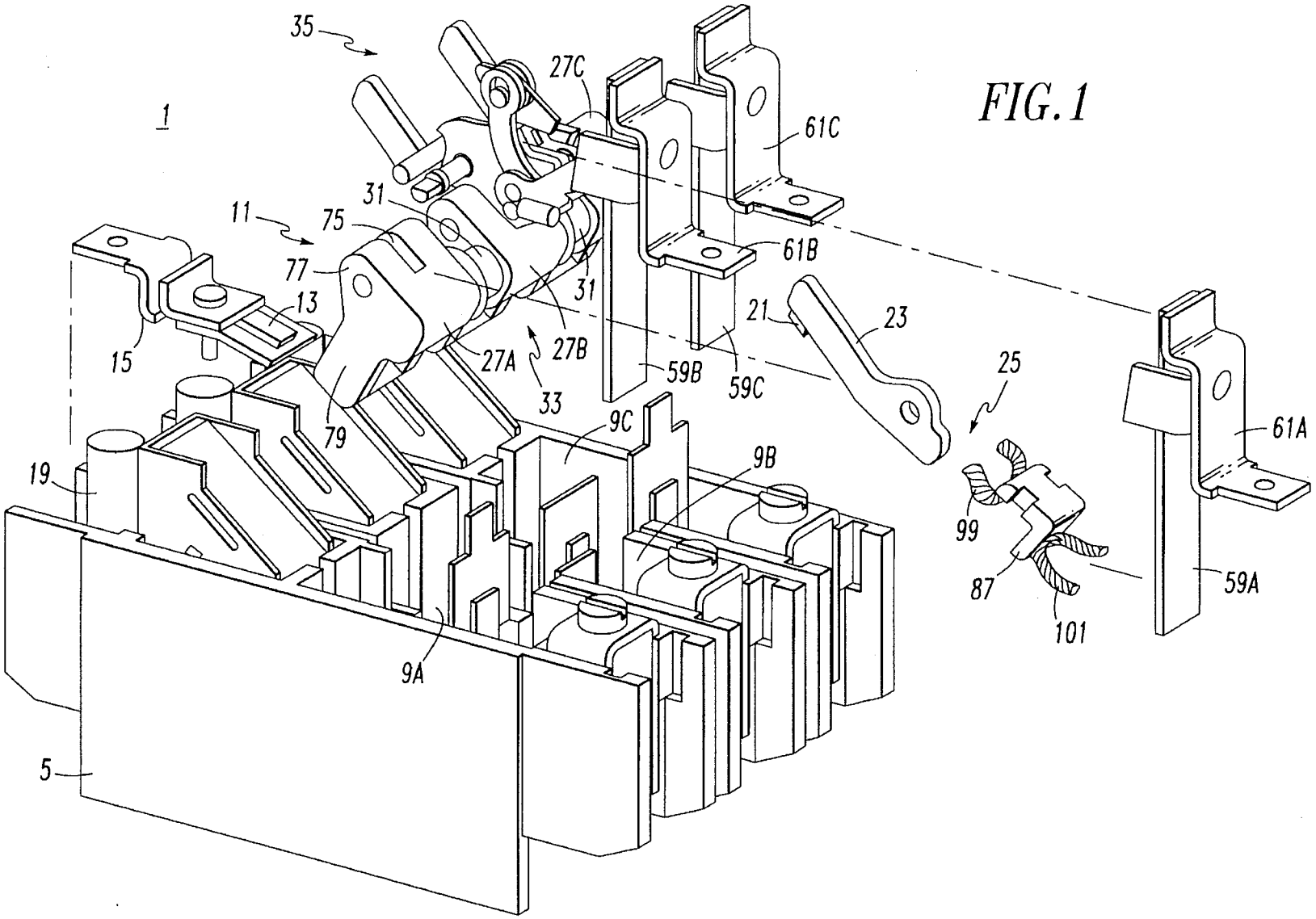
FIG. 1 is an exploded, isometric view of portions of a molded case circuit breaker incorporating the invention.
Figure 2:
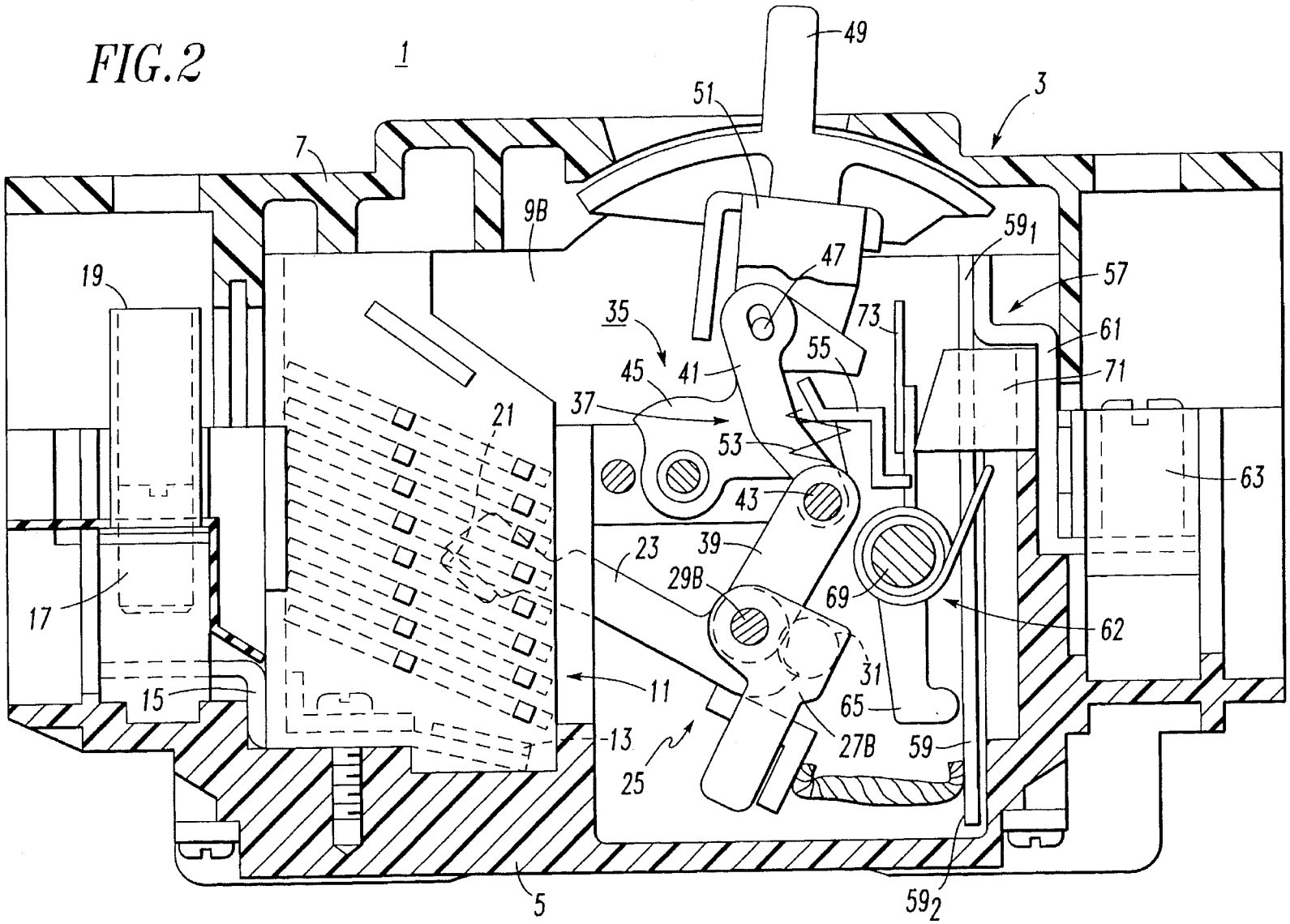
FIG. 2 is a longitudinal sectional view through an assembled circuit breaker incorporating the invention and shown in the open position.
Figure 3A:
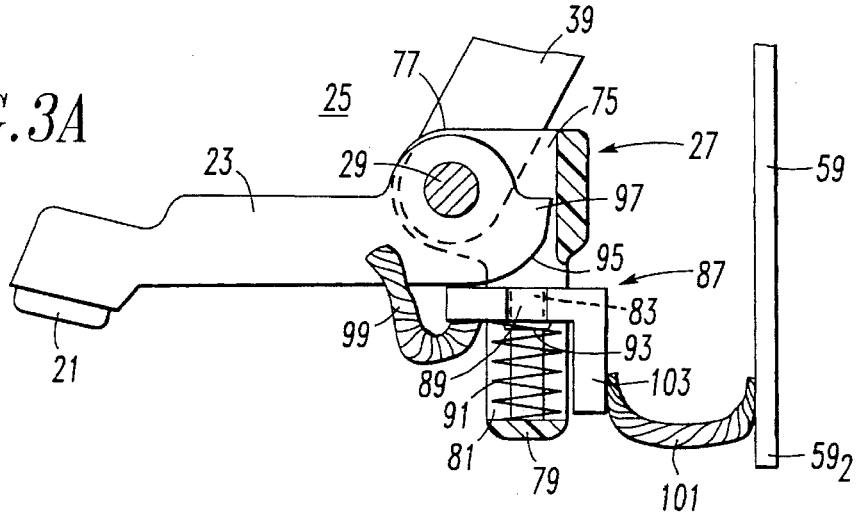
FIG. 3A is a side-view partially in section of a contact arm assembly which forms part of the circuit breaker of FIGS. 1 and 2 shown in the closed position.
Figure 3B:
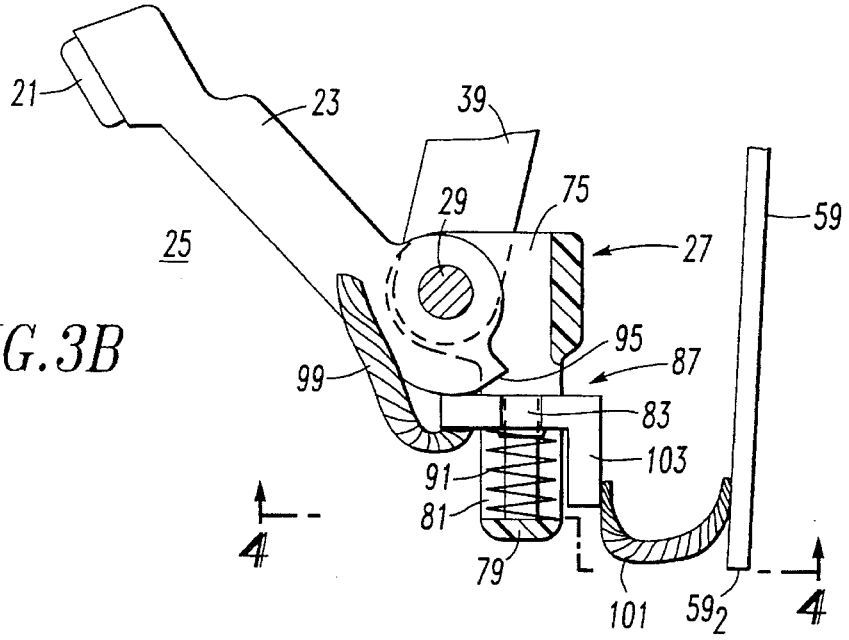
FIG. 3B is a view similar to that of FIG. 3A showing the contact arm in the blown open position.
Figure 4:
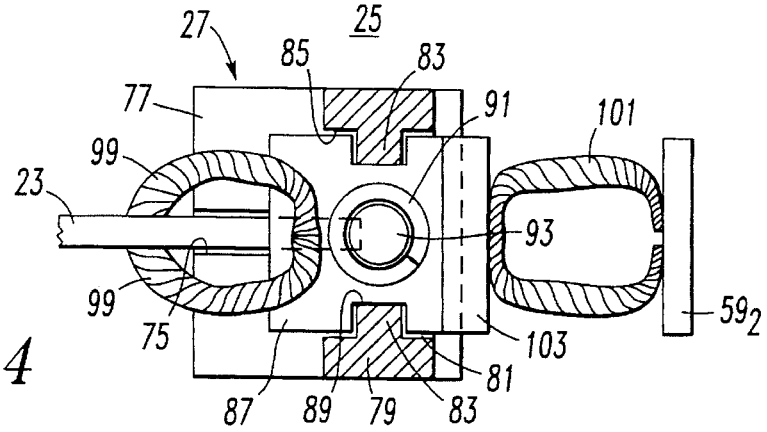
FIG. 4 is a section through FIG. 3B taken along the lines 4—4.

Referring to FIGS. 1 and 2, the circuit breaker 1 has a molded insulative casing 3 with a base 5 and a cover 7. The base is partitioned into pole compartments 9A, 9B, and 9C which electrically isolate the poles of the three-pole circuit breaker 1.

Each pole of the circuit breaker includes separable contacts 11 comprising a fixed contact 13 secured to a line side conductor 15 which forms at its outer end a line terminal to which a power system conductor (not shown) is secured by a line connector 17 which is protected from arcing by an insulated sleeve 19. Generally, parts are common to each pole and hence are identified by common reference characters. Parts referenced to a specific pole are identified by the suffix A,B,C.

The separable contacts 11 also include a moveable contact 21 secured to the end of a moveable arm contact arm 23 which forms part of a contact arm assembly 25. This contact arm assembly 25 includes a contact arm support 27 to which the contact arm 23 is pivotally connected by a pin 29. The contact arm supports 27A, 27B, and 27C for the three poles are joined together by cross bar sections 31 to form an integral cross bar member 33 which is rotatably mounted in the casing 3.

The cross bar member 3 is rotated by an operating mechanism 35 of the type which is described in U.S. Pat. No. 4,503,408, which is hereby incorporated by reference. This operating mechanism 35, which is located in the center pole compartment 9B. includes an over center toggle mechanism 37 having a lower toggle link 39 which is pivotally connected to the contact arm support 27B of the center pole by the pivot pin 29B as shown in FIG. 2. Upper toggle link 41 connected to the lower toggle link by a knee pin 43, is pivotally connected at its upper end to a cradle 45 by a pin 47. The operating mechanism 35 can be controlled manually by a handle 49. This handle 49 has a pivotally mounted handle yoke 51 which is connected to the knee pin 43 of the toggle mechansim 37 by a helical spring 53. Movement of the handle 49 to the open position shown in FIG. 2 brings the line of action of the spring 53 to the right of the pin 47 which collapses the toggle mechanism to rotate the cross bar member 31 and open all three poles of the circuit breaker. With the handle 49 moved counterclockwise in FIG. 2 to an on position, the toggle mechanism 37 is erected to rotate the cross bar member 31 and close the separable contacts 11. In the closed position, the cradle 45 is latched by a latch mechansim 55 which maintains the contacts in the closed position. A thermomagnetic thip mechanism 57 is responsive to overcurrent conditions to unlatch the cradle 45 which is rotated counterclockwise by the spring 53 until the pin 47 again moves to the left of the line of force of the spring. This trips the circuit breaker open by collapsing the toggle mechanism 37 to open the contacts as discussed above.

The thermomagnetic trip mechanism 57 includes a bimetal 59 which is fixed at its upper end $59_1$ to a load side conductor 61 which forms at its outer end a load terminal with connector 63. The lower, free end, $59_2$ is electrically connected in a manner to be described to the contact arm 23, so that with the circuit breaker closed the current drawn by the load passes through the bimetal 59. Persistent overload currents heat the bimetal 59 causing the lower end $59_2$ to bend to the left as seen in FIG. 2 until it contacts a trip bar 65 of a trip bar assembly 67. This rotates the trip bar assembly 67 about a trip bar shaft 69 thereby unlatching the latch mechanism 55 which releases the cradle 45 and trips the circuit breaker open.

The trip mechanism also includes a U-shaped magnetic yoke 71 which concentrates the magnetic field generated by current flowing through the pole so that in response to short circuit currents, an armature 73 mounted on the trip bar assembly 67 is attracted toward the magnetic yoke 71 to also unlatch the cradle and trip the circuit breaker open.

Referring to FIGS. 1, 3A, 3B and 4, the contact arm support 27 is molded of electrically insulative material with a slot 75 formed in a lobe 77 in which the contact arm 23 is pivotally mounted by the pin 29. The contact arm support 27 has a main body 79 with an opening 81 extending therethrough. A pair of opposed guides 83 extend logitudinally along the inside of the walls 85 forming the opening 81. An electrically conductive, generally planar blow open latch 87 is retained for longitudinal movement in the opening 81 by a pair of notches 89 which engage the guides 83.

A helical compression spring 91 seated on a boss 93 on the blow open latch 87, biases the blow open latch upward in the opening 81 against a caming surface 95 on the pivoted end 97 of the contact arm 23. This provides contact pressure for the separable contacts 11 when closed, and also accommodates for wear on the contacts 13 and 21. It also provides a blow open capability for the circuit breaker 1. Very high currents, such as those associated with a short circuit, generate magnetic repulsion forces which tend to rotate the contact arm 23 clockwise as viewed in FIG. 3A. When the repulsion force applied to the contact arm 23 generates a moment which exceeds a moment produced by the force applied by the spring 91, the contact arm rotates relative to the contact arm support to the blow open position shown in FIG. 3B. The caming surface 95 is shaped so that the contact arm 23 remains in the blow open position. Such a very high current will cause the trip mechanism to respond magnetically; however, there is a delay in the response, and the blow open feature allows the circuit breaker to interrupt the very high current more quickly, as is known.

As mentioned above, the blow open latch 87 is electrically conductive so that it can also form part of the conductive path between the contact arm 23 and the bimetal 59. In the embodiment shown in FIGS. 3A, 3B and 4, a first pair 99 of short flexible shunts are secured to each side of the contact arm and to one end of the blow open latch 87. Preferably, the shunts 99 are secured to the contact arm such as by braising, adjacent the pivot pin 29 in order to minimize their length. A second flexible shunt 101, also preferably double-ended, is connected between the bimetal 59 and the facing end of the blow open latch 87. Preferably, in order to further minimize the length of the second shunt 101, an extension in the form of a flange 103 is provided on the blow open latch 87, as the broad solid copper blow open latch 87 and flange 103 have better conductivity than the flexible shunt 101. An electrical path is also provided between the contact arm 23 and the blow open latch 87 through the interface of the cam surface 95 and the blow open latch. In some applications, this would provide an adequate low resistance connection, and, hence, the first shunt 99 could be eliminated, as shown in FIG. 2.

Figure 5:
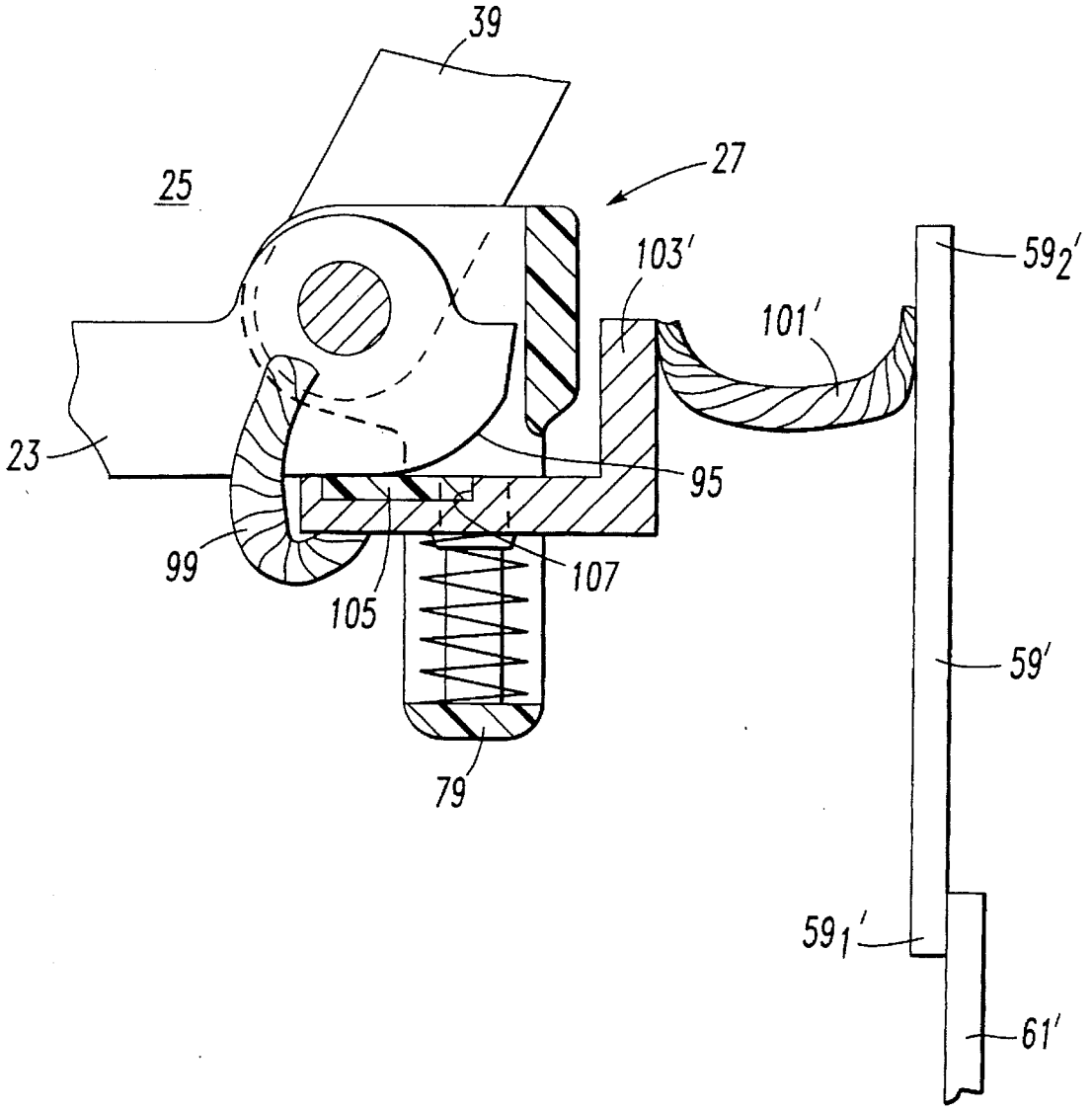
FIG. 5 is a fragmentary side elevation view partially in section of another embodiment of a contact arm assembly in accordance with the invention.

As an alternative, an insulating material 105 could be cast into a pocket 107 in the blow open latch 87' as shown in FIG. 5 to preclude erosion of the caming surface 95, in which case the first shunt 99 would carry all of the current. FIG. 5 shows another modification for use with a bimetal 59' which is fixed at its lower end $59_1$ to the load conductor 61'. In this instance, the flange 103' projects upwardly to minimize the length of the second shunt 101' connected to the free upper end $59_2$ of the bimetal 59'

While specific embodiments of the invention have been described in detail, it will be appreciated by those skilled in the art that various modifications and alternatives to those details could be developed in light of the overall teachings of the disclosure. Accordingly, the particular arrangements disclosed are meant to be illustrative only and not limiting as to the scope of invention which is to be given the full breadth of the claims appended and any and all equivalents thereof.

What is claimed is:

1. A circuit breaker comprising:

a set of separable contacts comprising a fixed contact and a moveable contact;

a fixed conductor on which said fixed contact is mounted;

a moveable contact assembly comprising a moveable contact arm having said moveable contact affixed adjacent one end and having a blow open camming surface adjacent a second end, and a contact arm support supporting said contact arm adjacent said second end of said contact arm for rotating said moveable contact arm between a closed position in which said separable contacts are closed and an open position in which said separable contacts are open;

an operating mechanism for rotating said contact arm support to open and close said separable contacts;

a trip mechanism for triggering said operating mechanism to rotate said contact arm support to open said separable contacts in response to predetermined conditions, said trip mechanism being positioned adjacent but spaced from said contact arm support;

means pivotally mounting said contact arm support for rotation by said operating mechanism, pivot means pivotally mounting said moveable contact arm to said contact arm support adjacent said second end of said contact arm, and an electrically conductive blow open latch engaging said blow open camming surface for establishing short circuit current conditions under which said moveable contact arm is blown open and rotated relative to said contact arm support away from said fixed conductor to open said separable contacts;

a first short flexible shunt connected between said moveable contact arm and said electrically conductive blow open latch; and a second short flexible shunt connected between said electrically conductive blow open latch and said trip mechanism.

2. The circuit breaker of claim 1 wherein said trip mechanism comprises a bimetal and said second short flexible shunt is connected to said bimetal.

3. The circuit breaker of claim 2 wherein said bimetal has a fixed end and a free end and said second short flexible shunt is connected to said free end of said bimetal.

4. The circuit breaker of claim 1 wherein said contact arm support comprises a body having an opening in which said electrically conductive blow open latch is slidably mounted, and a spring biasing said latch member against said blow open camming surface on said contact arm.

5. The circuit breaker of claim 4 wherein said electrically conductive blow open latch member has an integral extension with a free end to which said second short flexible shunt is connected, said extension extending in a direction which shortens said second flexible shunt over said second flexible shunt being connected directly to said latch member.

6. The circuit breaker of claim 5 wherein said trip mechanism has a bimetal with a fixed end and a free end and wherein said second flexible shunt is connected adjacent said free end of said bimetal.

7. The circuit breaker of claim 6 wherein said first short flexible shunt comprises two flexible conductors each connected to a different side of said contact arm and to said electrically conductive latch member.

8. The circuit breaker of claim 7 wherein said second flexible shunt comprises two flexible conductors each connected to a different side of said extension and to said free end of said bimetal.

9. The circuit breaker of claim 5 wherein said first flexible shunt is connected to said contact arm adjacent said pivot means to minimize its length.

10. The circuit breaker of claim 4 wherein said opening has side walls defining confronting guides and wherein said electrically conductive blow open latch has means engaging said guides for guiding movement of said electrically conductive blow open latch in said opening.

11. The circuit breaker of claim 1 including an electrically insulative member between said blow open camming surface on said contact arm and said electrically conductive latch member.

12. A circuit breaker comprising:

a set of separable contacts comprising a fixed contact and a moveable contact;

a fixed conductor on which said fixed contact is mounted;

a moveable contact assembly comprising a moveable contact arm having said moveable contact affixed adjacent one end and having a blow open camming surface adjacent a second end and a contact arm support supporting said contact arm adjacent said second end of said contact arm for rotating said moveable contact arm between a closed position in which said separable contacts are closed and an open position in which said separable contacts are open;

an operating mechanism for rotating said contact arm support to open and close said separable contacts;

a trip mechanism for triggering said operating mechanism to rotate said contact arm support to open said separable contacts and response to predetermined conditions, said trip mechanism being positioned adjacent but spaced from said contact arm support;

means pivotally mounting said contact arm support for rotation by said operating mechanism, pivot means pivotally mounting said moveable contact arm to said contact arm support adjacent said second end of said contact arm, and an electrically conductive blow open latch mechanically and electrically engaging said blow open camming surface tier current flow between said contact arm and said electrically conductive latch and for establishing short circuit current conditions under which said moveable contact arm is blown open and rotated relative to said contact arm support away from said fixed conductor to open said separable contacts; and a short flexible shunt connected between said electrically conductive blow open latch and said trip mechanism.

13. The circuit breaker of claim 12 wherein said contact arm support comprises a body having an opening in which said electrically conductive blow open latch is slidably mounted and a spring biasing said electrically conductive blow open latch against said blow open camming surface on said contact arm.

14. The circuit breaker of claim 13 wherein said blow open latch member has an integral extension with a free end to which said short flexible shunt is connected, said extension extending in a direction which shortens said short flexible shunt over a flexible shunt being connected directly to said latch member.

15. The circuit breaker of claim 14 wherein said short flexible shunt comprises a pair of flexible conductors each connected to a side of said extension and to a free end of a bimetal in said trip mechanism.

16. The circuit breaker of claim 13 wherein said opening has side walls defining confronting guides and wherein said electrically conductive blow open latch has means engaging said guides for guiding movement of said electrically conductive blow open latch in said opening.

* * * * *